United States Patent [19]

Berg

[11] Patent Number: 4,491,706

[45] Date of Patent: Jan. 1, 1985

[54] CIRCUIT BREAKER WITH MEANS FOR PRODUCING A FLOW OF ARC-EXTINGUISHING GAS

[75] Inventor: Samuel Berg, Ludvika, Sweden

[73] Assignee: ASEA Aktiebolag, Västerås, Sweden

[21] Appl. No.: 517,019

[22] Filed: Jul. 25, 1983

[30] Foreign Application Priority Data

Jul. 16, 1982 [SE] Sweden ..... 8204708

[51] Int. Cl.[3] ..... H01H 33/88

[52] U.S. Cl. ..... 200/148 A; 200/150 G

[58] Field of Search ..... 200/148 A, 150 G

[56] References Cited

U.S. PATENT DOCUMENTS 3,733,452 5/1973 Strippoli et al. ..... 200/148 A 4,070,558 1/1978 Stewart et al. ..... 200/148 A

FOREIGN PATENT DOCUMENTS 2246048 4/1975 France ..... 200/148 A

*Primary Examiner*—Robert S. Macon

*Attorney, Agent, or Firm*—Watson, Cole, Grindle & Watson

[57] ABSTRACT

A puffer type circuit breaker is provided with a pump means consisting of a piston and a cylinder for producing a blast of arc-extinguishing gas. The movable arcing contact of the circuit breaker and the cylinder are connected to an operating device via a rod axially displaceable through an opening in the piston. In the piston there is arranged a check valve, which upon closing of the breaker opens for subsequent filling of the pump chamber with arc-extinguishing gas. The check valve comprises a guiding sleeve of a ductile material (e.g. polyetrafluoro ethylene), which sealingly surrounds the rod and is fixed with a certain axial mobility in the opening in the piston arranged for the rod. The sleeve controls (or is fixedly connected to) the movable valve means of the check valve and, in addition, serves as a seal and a bearing between the rod and the piston.

6 Claims, 3 Drawing Figures

CIRCUIT BREAKER WITH MEANS FOR PRODUCING A FLOW OF ARC-EXTINGUISHING GAS

BACKGROUND OF THE INVENTION

1. Field of the Invention

The present invention relates to puffer type circuit breakers, and in particular to such circuit breakers having a gaseous arc-extinguishing medium and which generate a blast of arc-extinguishing gas towards the contact area of the circuit breaker.

2. Prior Art

Puffer type circuit breakers have a pump means consisting of a piston and a cylinder in order to compress gas in a pump chamber upon opening of the circuit breaker, from which pump chamber a flow of arc-extinguishing gas is led towards the contact area. Usually the piston of the pump means is fixedly arranged, whereas the cylinder is fixed to the movable contact, which is connected to an operating device via axially displaceable pull rod. The rod passes through an opening in the piston, and sealing and bearing means are arranged between the piston and the rod. In order to refill the pump chamber with arc-extinguishing gas upon closing of the breaker, there is often arranged a check valve in the pump piston. This valve is normally provided with a spring which biasses the movable valve member towards the closed valve position. Upon closing of the breaker, there will arise a pressure difference between the pump chamber and the surroundings which acts against the spring force, whereby the valve opens, enabling new arc-extinguishing gas to flow into the pump chamber. Circuit breakers of this design are known, for example, from the ASEA pamphlet KT 20-109E, FIG. 14, April 1978.

SUMMARY OF THE INVENTION

The object of the present invention is to provide a simplification and improvement of the design described above. This is achieved by a design in which the check valve comprises a guiding sleeve of a ductile material for the movable valve member, said sleeve sealingly surrounding the rod and being fixed with a certain axial mobility in the opening, arranged for the rod, in the wall of the pump chamber, the sleeve also constituting sealing and bearing between the rod and the wall. By using for the check valve a guiding sleeve of a ductile material which tightly surrounds the pull rod, several advantages are obtained. Because the guiding sleeve is influenced by the friction against the pull rod upon a change in position of the rod, the guiding sleeve and thereby the movable valve member assume a changed position at an earlier stage than in a design in which a pressure difference must first be built up in order to bring about a change of the valve position. Upon opening of the breaker, an undesired valve flow can therefore be stopped at an early stage, whereas upon closing of the breaker a rapid supply of arc-extinguishing gas to the pump chamber can take place. Further, a separate spring to maintain the valve closed, as well as separate sealing and bearing between the piston and the pull rod, can be eliminated.

BRIEF DESCRIPTION OF THE DRAWING

The invention will be explained in greater detail with reference to the two embodiments shown in the accompanying drawing, wherein.

DESCRIPTION OF THE PREFERRED EMBODIMENTS

Figure 1:
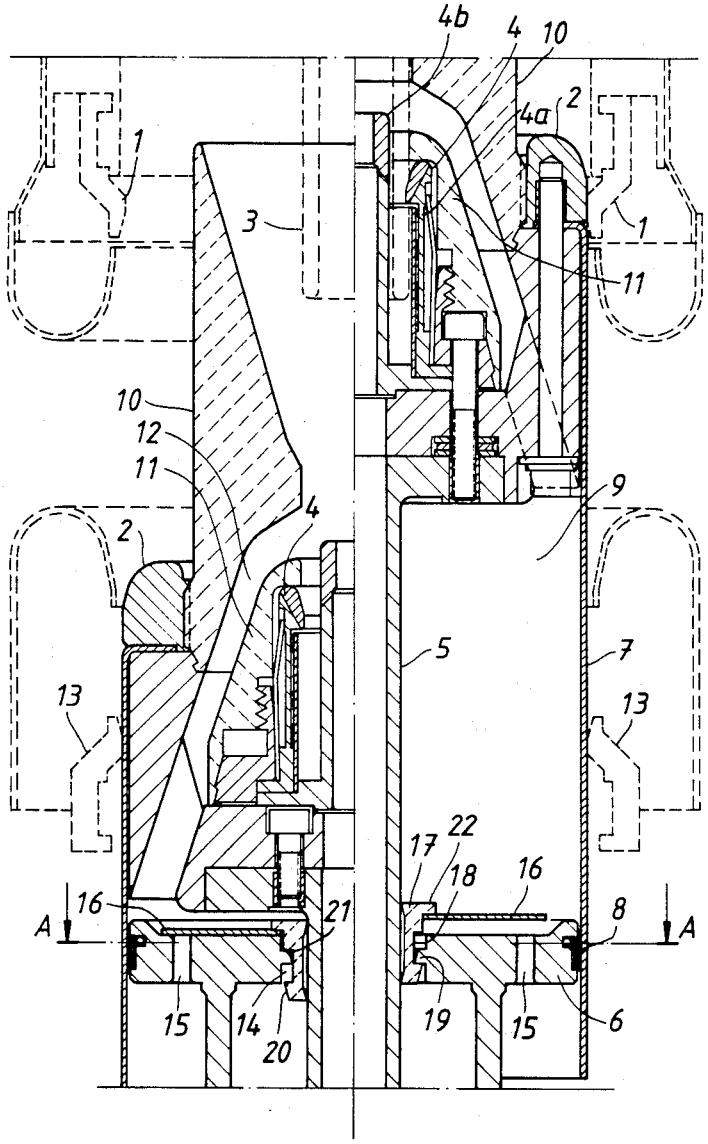
FIG. 1 is an axial section through the central portion of a circuit breaker according to the invention, whereby the portion of the figure to the right of the center line shows the breaker in the closed position and the portion of the figure to the left of the center line shows the breaker in the open position.
Figure 2:
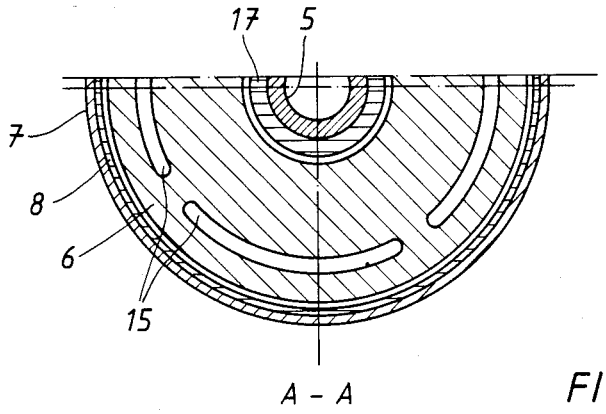
FIG. 2 is a cross-section through the circuit breaker along the line A—A in FIG. 1.

The central portion of a circuit breaker shown in FIGS. 1 and 2 is housed in a breaking chamber (not shown), which is preferably completely closed and filled with electro-negative gas, for example, sulphur hexaflouride, of an overpressure of a few atmospheres. The circuit breaker has a main contact unit with a fixed and a movable contact 1 and 2, respectively, and with an arcing contact unit with a fixed and a movable arcing contact 3 and 4, respectively. The movable arcing contact 4 comprises, on the one hand, an outer sleeve contact with spring-actuated contact fingers 4*a* and, on the other hand, an inner tubular contact 4*b*. The movable contacts 2 and 4 are connected to an operating device (not shown) via an axially displaceable pull rod 5. The circuit breaker is provided with a pump means consisting of a fixedly arranged piston 6 and a cylinder 7, which is fixed to the movable contacts 2, 4 and move together with these. Between the piston and the cylinder there is arranged a sliding seal 8. The piston 6 and the cylinder 7 define a pump chamber 9. On the movable contact there are also mounted a blast nozzle 10 and an inner sleeve 11 of a suitable insulating material, for example polytetrafluoro ethylene. Between the sleeve 11 and the blast nozzle 10 there is formed a channel 12 for arc-extinguishing gas which extends from the pump chamber 9 to the area between the arcing contacts 3 and 4 (the contact area). The external current connection to the movable contacts 3, 4 takes place with the aid of sliding contact 13 via the blast cylinder 7, which is made of copper or aluminium.

The pull rod 5 passes through a central opening 14 in the blast piston 6, in which also valve holes 15 for a check valve has been provided. The check valve comprises an annular valve disc 16 of metal for covering the valve holes 15, as well as a guiding sleeve 17 of ductile material, which is pressed into the central opening 14 where, in addition to its check valve function, it also serves as a seal and a bearing between the pull rod 5 and the piston 6. The guiding sleeve has an outwardly facing groove 18 extending around it, with which an inwardly-directed edge portion 19 on the piston 6 is in engagement. The width of the groove is greater than the width of the edge portion, whereby the sleeve will have a certain axial mobility. One end portion of the sleeve has a hook-like shape with a chamfered front surface 20 to facilitate the pressing of the sleeve into the opening 14.

For the same purpose, the inwardly-facing surface 21 on the edge portion 19 of the piston may be chamfered. The other end portion of the sleeve is formed with an outwardly-directed shoulder 22, which engages the inner edge of the metal ring 16 to retain it.

For the guiding sleeve 17 to be easily pressed into and fixed in the opening 14, the sleeve should be made of a material with the ability to change its dimension under pressure and, after removal of the pressure, to resume its original shape. In addition, the material should be resistant to the decomposition products of the $SF_6$ gas. As an example of such material may be metioned polytetrafluoro ethylene.

When operating the circuit breaker from the closed to the open position or vice versa, the guiding sleeve 17 is displaced due to its friction against the pull rod even at the initial stage of the movement of the rod. In this way, the valve function is considerably more rapid than in such designs where a change of the valve position can take place only after a pressure difference has built up across the valve. In addition, the invention results in a considerably simplification since, among other things, no valve springs are required.

Figure 3:
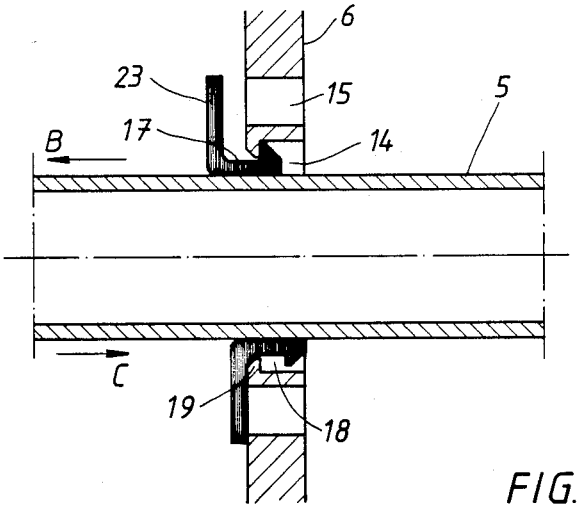
FIG. 3 is an axial section through an alternative embodiment of a check valve intended for such a breaker, whereby the portion of the figure above the center line shows the valve in the open position and the portion of the figure below the center line shows the valve in the closed position.

FIG. 3 shows alternative embodiment of a check valve for a circuit breaker according to the invention, in which the upper half of the figure shows the valve in the open position after movement of the pull rod 5 in the direction of the arrow B, whereas the lower half of the figure shows the valve closed position after movement of the rod 5 in the direction of the arrow C. In this embodiment one end portion of the guiding sleeve 17 is formed with an outwardly-directed collar 23 which forms the movable valve member of the check valve. Thus, this embodiment differs from that shown in FIG. 1 in that the guiding sleeve and the valve disc, which covers the valve holes, are integrated in one single unit.

The invention is not limited to the embodiment shown, but several modifications are feasible. For example, the pump means of the circuit breaker may be provided, instead of the shown arrangement, with a fixed cylinder and a movable piston, whereby the check valve is arranged in the end wall of the cylinder. Such an embodiment is covered by the appended claims, in which the expression "the wall of the pump chamber" comprises both the wall formed by the cylinder and the wall formed by the piston.

What is claimed is:

1. Electric circuit breaker having a gaseous arc-extinguishing medium comprising:

a first and a second contact, one of said contacts being movable in relation to the other contact between an engaged and a disengaged position;

a pump means including a piston and a cylinder, said piston being joined to said first contact, and said cylinder being joined to said second contact, said pump means, during a breaking operation, compressing the gas in a pump chamber to create a blast of arc-extinguishing gas towards the contact area of the circuit breaker;

an operating device being connected to said movable contact by means of a rod, said rod being axially displaceable through an opening in the wall of said pump chamber;

a valve hole in the wall of said pump chamber;

A check valve including a movable valve member associated with said valve hole, said movable valve member being arranged, upon opening of the breaker, to cover the valve hole and, upon closing of the breaker, to open for the supply of gas to the pump chamber;

said check valve comprising a guiding sleeve of a ductile material for the movable valve member, said sleeve tightly surrounding the rod and being fixed with a certain axial mobility in the opening arranged for the rod in the wall of the pump chamber, whereby the sleeve also constitutes a seal and bearing between said rod and said wall.

2. Circuit breaker according to claim 1, wherein the guiding sleeve (17) has an outwardly-facing groove (18) extending around it, with which an inwardly-directed edge portion (19) in the wall of the pump chamber is in engagement, whereby the width of the groove (18) is greater than the width of said edge portion (19).

3. Circuit breaker according to claim 1, wherein one edge portion of the guiding sleeve (17) has a hook-like design with a chamfered front surface (20) for pressing into the opening (14), arranged for the rod (5), in the wall of the pump chamber (9).

4. Circuit breaker according to claim 3, wherein the movable valve member (16) consists of a metal ring which surrounds the rod (5) and is retained by an outwardly-directed shoulder (22), located on the other end portion of the guiding sleeve (17), said shoulder engaging the inner edge of the metal ring.

5. Circuit breaker according to claim 3, wherein the other end portion of the guiding sleeve (17) is provided with an outwardly-directed collar (23) which forms the movable valve member of the check valve.

6. Circuit breaker according to claim 1, wherein the guiding sleeve (17) is made of polytetrafluoro ethylene.

* * * * *